US005178643A

United States Patent [19]

Schimweg

[11] Patent Number: 5,178,643

[45] Date of Patent: Jan. 12, 1993

[54] PROCESS FOR PLATING SUPER ABRASIVE MATERIALS ONTO A HONING TOOL

[75] Inventor: John J. Schimweg, St. Charles, Mo.

[73] Assignee: Sunnen Products Company, St. Louis, Mo.

[21] Appl. No.: 703,415

[22] Filed: May 21, 1991

[51] Int. Cl.[5] ..... B24D 3/00

[52] U.S. Cl. ..... 51/293; 51/295; 51/309; 205/110

[58] Field of Search ..... 51/293, 295, 309; 204/14.1, 39

[56] References Cited

U.S. PATENT DOCUMENTS

| | | | |
|---|---|---|---|
| 4,075,794 | 2/1978 | Blaylock | 51/343 |
| 4,155,721 | 5/1979 | Fletcher | 51/295 |
| 4,197,680 | 4/1980 | Althen et al. | 51/343 |
| 4,253,279 | 3/1981 | Althen | 51/346 |
| 4,832,707 | 5/1989 | Kamohara et al. | 51/293 |
| 4,868,069 | 9/1989 | Darrow | 51/309 |
| 4,973,338 | 11/1990 | Gaetz et al. | 51/295 |

*Primary Examiner*—William R. Dixon, Jr.
*Assistant Examiner*—Willie J. Thompson
*Attorney, Agent, or Firm*—Haverstock, Garrett & Roberts

[57] ABSTRACT

An improved method for plating super abrasive materials onto the working portion of a honing tool, which method includes plating or otherwise coating a relatively thin layer of a composite material comprising a metal or metal alloy material having a friction reducing or lubricating type material occluded or otherwise associated therewith over the top of the bond already established between the abrasive particles and the working portion of the honing tool so as to substantially reduce and minimize the occurrence of having stock material build-up and collect between the abrasive particles, which stock build-up causes galling or scoring of the honed work surface during a honing operation. In the preferred embodiment, the composite material comprising the anti-galling coating surface is a nickel/phosphorous alloy material having micron-sized Teflon particles occluded therein. The present method substantially increases the quality of the finished work product as well as the overall service life of the honing tool itself. An improved honing tool construction is also produced through usage of the present method.

37 Claims, 1 Drawing Sheet

PROCESS FOR PLATING SUPER ABRASIVE MATERIALS ONTO A HONING TOOL

The present invention relates to an improved method for plating super abrasive materials such as abrasives that include diamond particles, particles of cubic boron nitride and other like hard materials onto a particular substrate such as a honing tool, which method includes coating the plated abrasive bond with a thin layer of a composite material including a metal or metal alloy material containing a friction reducing or lubricating type substance such as a nickel/phosphorous alloy which contains micron-sized Teflon particles occluded therein so as to provide anti-stick and anti-gall properties to the bond between the super abrasive particles. This improved plating process substantially eliminates any galling or scoring of the honed work surface during a honing operation due to stock material which may accumulate between the abrasive particles and it increases the overall service life of the honing tool. Although coating the abrasive bond with a nickel/phosphorous/Teflon (Ni-P-PTFE) composite material is preferred, it is recognized that a wide variety of other metal or metal alloy composite materials containing a friction reducing type agent may likewise be utilized to provide the desired anti-stick and anti-gall properties to the bond.

BACKGROUND OF THE INVENTION

The abrasive portion of a honing tool is the working portion of the tool as it is this portion of the tool which engages a particular workpiece under pressure during a honing operation and removes material therefrom until the desired final diameter of the workpiece has been achieved. As stock is being removed from a workpiece during a honing operation, metal chips and shavings have a tendency to load or stack up between the protruding abrasive particles on the honing tool, such build-up eventually leading to galling or scoring of the honed work surface. This is a continuing and on-going problem in many honing operations and the accumulation or adherence of such stock material between the abrasive particles is particularly true of ductile type materials such as stainless steel which produce long stringy chips or shavings during the honing process. Typically, such long stringy chips will fill up or clog the spaces between the protruding abrasive particles on the tool and then, after they have been hardened by compaction through the honing action itself, enough heat is eventually generated during honing that these chips or shavings will actually weld and bond themselves to the bonding matrix between the adjacent abrasive particles thereby causing galling or scoring of the honed work surface as the honing operation continues. Also, this stock material build-up reduces the cutting effectiveness of the abrasive particles and, once the abrasive particles wear to the same surface level as the stock build-up between such particles, any effective cutting action is eliminated. This phenomena therefore not only diminishes the quality of the finished work product but it also diminishes the overall service life of the tool and eventually leads to the termination of such tool as an effective cutting member.

Various means have been utilized in an effort to reduce and minimize the occurrence of having stock material build-up and collect between the abrasive particles of a honing tool thereby causing the aforementioned problems. For example, U.S. Pat. No. 4,155,721 discloses a dual bonding process for making single layered grinding tools wherein a metallic substrate is pre-etched so as to suitably cavitate the substrate surface prior to plating. Etching is believed to create small cavities in the substrate surface, each such cavity being adapted to individually receive a portion of an abrasive particle. This arrangement provides a stronger mechanical bond between the abrasive particles and the metal plated surface of the substrate so that at least a portion of the abrasive particles are recessed below the shear plane. This process further includes a second plating step wherein a second metallic bond matrix can thereafter be applied over the first metal coating to prevent stock build-up and adherence to the bond matrix between the abrasive particles. This second plating bath is comprised of metal ions only and, when the type and thickness of this second coating of metal is properly selected for the intended application of the tool, this second coating of metal between the abrasive particles helps to prevent glazing of the cutting edge of the tool due to the same stock build-up between the abrasive particles as previously explained.

U.S. Pat. Nos. 4,832,707; 4,973,338; and 4,868,069 likewise disclose various metal-bonded tools and methods for manufacturing the same including various anti-static and abrasion-resistant coatings for use with such abrasive products to decrease the incidences of stock build-up between the abrasive particles thereby improving the overall quality of the finished work product, including grinding efficiency and finishing accuracy. More particularly, U.S. Pat. No. 4,832,707 discloses a method of manufacturing a metal-bonded tool which uses diamond particles as the abrasive material for high efficiency grinding. This patent specifically addresses the problem associated with the grinding chips accumulating in the hollows formed within the bond holding the abrasive particles to the particular substrate and attempts to solve such problem by regulating the quantity of the carbon or graphite and the size of such precipitates in the bond.

U.S. Pat. No. 4,973,338 likewise attempts to reduce the incidence of build-up or clogging of the abrasive surface by treating the coated abrasive materials with an appropriate amount of a quaternary ammonium anti-static compound comprising about 15 to about 35 carbon atoms in a molecular weight not less than about 300. It has been found that coated abrasive materials, thus treated, have a combination of anti-static, lubricity and anti-loading characteristics which provide improved abrading efficiency and longer abrading life.

U.S. Pat. No. 4,868,069 discloses a method for improving the abrasion resistance of various substrates wherein the substrate is coated with a relatively soft metal matrix in which abrasion-resistant grit particles are embedded. The coating comprises abrasion-resistant particles that protrude from a metal matrix having a surface that is hardened relative to the bulk of the metal matrix, the coating being metallurgically bonded to the substrate. Embedding grit particles in the hardened coating prevents the grit particles from dislodging and it also prevents catastrophic cracks from developing in the coating.

Although all of the above-identified known prior art processes appear to address a similar type problem, namely, accumulation and adherence of stock build-up between the abrasive particles in the substrate as well as the destruction or plastic deformation of the bond therebetween with a resultant deterioration of finishing accuracy and quality, none of the known processes include the use of a nickel/Teflon or other metal or metal alloy composite material having a lubricant type substance occluded therewithin as an anti-galling agent for applying to and coating over the top of the bond already established between the plated abrasive particles on a honing tool as previously explained. The self-lubricating or friction reducing characteristics associated with Teflon particles or other suitable lubricating agents as will be hereinafter further explained in combination with the nickel or other metal or metal alloy material contained in the composite coating material produces both an anti-stick, anti-galling coating surface as well as a strong, abrasive resistant coating which adheres to and becomes part of the underlying bond and is capable of withstanding the forces and stresses of a honing operation without destruction and/or deformation. For these and other reasons, the present process differs both composition wise and application wise from the bonding processes disclosed in the known prior art.

SUMMARY OF THE INVENTION

The present invention teaches an improved process for plating super abrasive particles onto a honing tool which, in its preferred embodiment, includes coating and bonding a metal/Teflon composite material such as nickel/phosphorous/Teflon (Ni-P-PTFE) as an anti-galling or friction reducing agent over the top of the bond already established between the plated abrasive particles and the honing tool once such particles are bonded to such honing tool. In the preferred method, the plated abrasive bond is coated with a thin layer of an electroless nickel/phosphorous alloy that contains micron-sized Teflon particles embedded therewithin so as to provide anti-stick and anti-gall properties to the bond. The nickel/phosphorous/Teflon composite coating applied over the known bond is typically about 0.0002 to 0.0005 inch thick so that the overall bond thickness between the abrasive particles will remain approximately the same as compared to previous known bonding techniques. It is recognized that any number of coatings of the friction reducing, anti-galling agent can be applied as well as any thickness of such agent. Use of the nickel/phosphorous/Teflon composite material over the appropriate bond matrix necessary for attaching a super abrasive material to a honing tool prevents the metal chips and shavings produced during the honing operation from building up and collecting between the abrasive particles thereby substantially eliminating and alleviating the above-identified problems of galling and scoring of the particular workpiece during honing. Although use of the nickel/phosphorous/Teflon composite coating is preferred, other nickel/Teflon composite materials as well as other metals and alloys capable of being joined to a metal substrate and having a surface friction reducing agent associated therewith may also be utilized as the anti-galling agent.

The construction of the honing tool itself after the working portion of such tool is coated with the present anti-galling coating agent is also new and novel in the honing tool art.

It is therefore a principal object of the present invention to teach an improved process for plating super abrasive materials onto a honing tool.

Another object is to provide a means for substantially reducing the build-up of stock material between the protruding abrasive particles on a honing tool during a honing operation.

Another object is to provide a means for minimizing the glazing of the cutting edge of the honing tool as it wears during a honing operation.

Another object is to provide a means for preventing the metal chips and shavings produced during a honing operation from bonding to the abrasive portion of the honing tool during a honing operation.

Another object is to teach the construction of a honing tool wherein the bonding matrix for attaching the abrasive particles to the working portion of the tool includes improved anti-stick and anti-galling characteristics.

Another object is to provide a means for preventing the galling or scoring of the honed work surface during a honing operation.

Another object is to teach a method for plating super abrasive materials onto a honing tool wherein a nickel/Teflon or other metal or metal alloy/friction reducing type composite material is utilized as an anti-galling agent.

Another object is to teach a method for plating super abrasive materials onto a honing tool wherein a nickel/phosphorous/Teflon composite material is utilized as an anti-galling agent.

Another object is to provide a method for plating super abrasives onto a honing tool wherein a substantially smooth, anti-stick, anti-gall bonding surface is produced which prevents the metal chips and shavings produced during a honing operation from building up and collecting on such surface between the abrasive particles.

These and other objects and advantages of the present invention will become apparent to those skilled in the art after considering the following detailed specification in conjunction with the accompanying drawings.

DETAILED DESCRIPTION OF THE INVENTION

Figure 1:
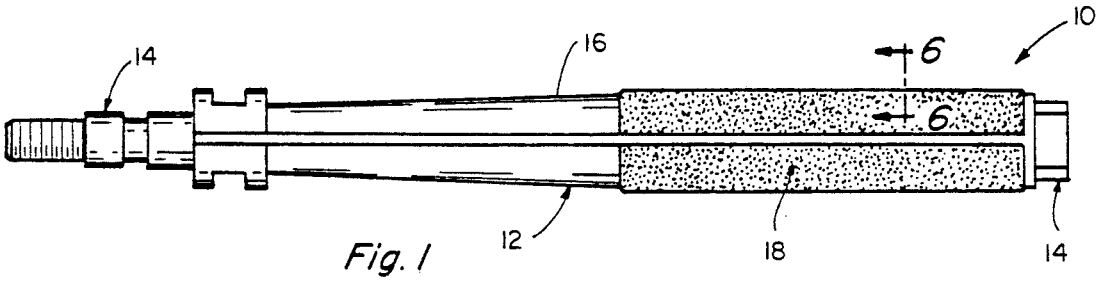
FIG. 1 is a side-elevational view of one embodiment of a typical honing mandrel, including a tubular honing member and an expander member which is slidably movable therewithin.

Referring to the drawings more particularly by reference numbers wherein like numbers refer to like parts, number 10 in FIG. 1 identifies one of many possible embodiments of a typical honing tool or mandrel commonly used for attachment to a honing machine to accomplish a honing operation. The honing tool or mandrel 10 includes an elongated substantially tubular honing member 12 having a passageway or bore (not shown) extending therethrough from end-to-end adaptable for cooperatively receiving an expander member or arbor 14 positioned therethrough. The honing member 12 includes an outer surface 16, preferably substantially cylindrical, a portion 18 of which is typically plated with a super abrasive material as illustrated in FIG. 1. Such super abrasive materials typically include diamond particles or particles of cubic boron nitride in a suitable binder or other like hard materials. Use of such super abrasive materials is well known in the honing art. Typically, only a portion of the honing tool is plated with such abrasive particles and the specific arrangement and amount of coverage of such abrasive particles on a particular honing tool is usually dependent upon the particular application and the surface finish desired after honing. Although a specific abrasive configuration is illustrated in FIG. 1, it is recognized that a wide variety of different abrasive patterns may be utilized depending upon the particular application desired and the type of super abrasive material being used. Nevertheless, regardless of the specific arrangement and amount of coverage of a particular super abrasive material, the present invention is directed specifically and particularly to an improved process for plating such super abrasive particles onto the working portion of the honing tool such as the abrasive portion 18 illustrated in FIG. 1. Other honing tool or mandrel constructions for which the present invention is likewise particularly useful are those single pass through honing tool constructions disclosed in Sunnen U.S. Pat. Nos. 4,197,680 and 4,253,279 as well as a variety of radially expandable mandrel constructions such as the construction illustrated in FIG. 7. Other radially expandable mandrel constructions having particluar utility for the present invention include those constructions disclosed in Sunnen U.S. Pat. Nos. 3,216,155; 4,524,549; and 4,555,875.

Figure 2:
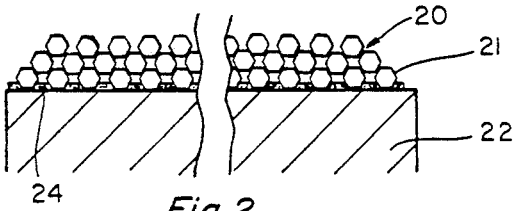
FIG. 2 a side-elevational view illustrating the first plating process associated with the present invention.

More specifically, the present improved process or method utilizes a nickel/phosphorous/Teflon (Ni-P-PTFE) composite material, or other metal or metal alloy material having a friction reducing or surface lubricating type material occluded or otherwise associated therewith, as the anti-galling agent for applying to and coating the bond established between the plated abrasive particles and the honing tool once such particles are bonded by known techniques to such tool. Although any suitable means for attaching or bonding the abrasive particles to the tool substrate may be utilized without impairing the teachings of the present invention, an electroplated process is generally preferred. In this regard, multi-layers of a super abrasive material such as diamond particles and/or cubic boron nitride particles are positioned and held against the tool substrate and an initial thin layer of an electroplated material is applied thereagainst using known techniques in order to hold and attach the adjacent first layer of particles to the substrate. The results of this first plating process or bath are illustrated in FIG. 2 wherein multi-layers of a super abrasive grit 20 are held against the tool substrate 22 and an initial thin bond of electroplated material 24 is formed by and between the first adjacent layer of abrasive grit particles 21 and the tool substrate 22. Well known electro plating processes are available for accomplishing this task. Electroplated materials typically used for this type of bond application include such metals as nickel, copper, cobalt and chromium; such metal alloys as nickel phosphorous, nickel boron and brass; and other materials including autocatalytic or electroless plating. Autocatalytic plating refers to a process wherein the deposit material itself catalyzes the reduction reaction at the tool surface.

After this first initial electroplated or electroless plated process is applied to the particular abrasive particles and the associated substrate, the adjacent first layer of particles such as the particles 21 illustrated in FIG. 2 is only loosely secured or bonded to the substrate 22. In other words, this initial bond 24 covers only a very small portion of the overall height of the individual abrasive particles forming the adjacent layer. Once this first plating process is completed, the surplus layers of abrasive particles 20 (FIG. 2) are thereafter removed by known means and the plating process or bath is re-activated and a thicker plated deposit is applied to the initial bond 24 illustrated in FIG. 2 thereby further bonding the first layer of abrasive particles 21 to the substrate 22. This re-activation of the plating process (second plating process) allows additional electroplated material 26 to be applied to the previous bond 24 to build-up the bond between such particles and the substrate 22. In this regard, use of the term "bond" in describing the present process refers to a mechanical bond, not a chemical or metallurgical bond. The plated deposit material produces a close fitting socket that fills into the irregular abrasive grit surface to attach such abrasive grit to the tool substrate. The results of this second plating process are illustrated in FIG. 3.

Figure 3:
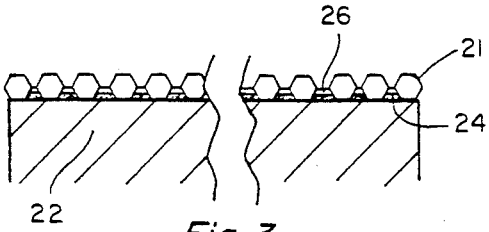
FIG. 3 is a side-elevational view illustrating the second plating process associated with the present invention.
Figure 5:
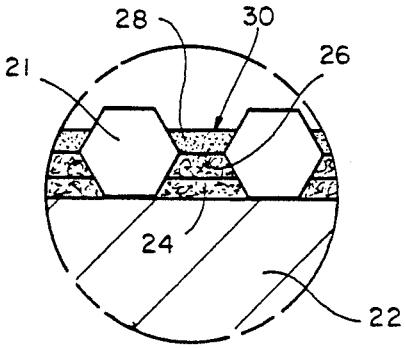
FIG. 5 is an enlarged, partial side-elevational view showing the bond matrix between two adjacent abrasive particles of FIG. 4.

This second plating operation helps to fill the voids between the abrasive particles 21 and the substrate 22 so as to build-up the bond therebetween as illustrated in FIGS. 3 and 5. Normally, a suitable bond between the abrasive particles and the substrate is achieved when the space between adjacent particles is filled with the bonding agent to a point somewhere between 50% and 90% of the particle height. Referring to FIGS. 2 and 3, it can be seen that the overall height of the bond (24 and 26) between the abrasive particles 21 illustrated in FIG. 3 is greater than the overall height of the initial bond 24 illustrated in FIG. 2. It is recognized that the above-described plating process can be re-activated and continued until the overall desired bond height is achieved. This portion of the present process just described is one of the known methods presently used for bonding super abrasive particles to a particular honing tool.

Figure 4:
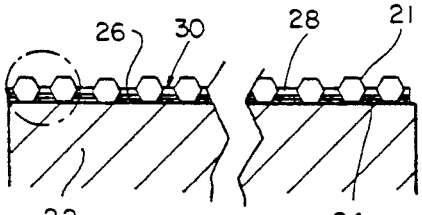
FIG. 4 is a side-elevational view illustrating the third plating process associated with the present invention.

The main improvement of the present process as compared to the known processes for plating super abrasive materials onto a particular substrate lies in the use of a nickel/phosphorous/Teflon (Ni-P-PTFE) or other equivalent type material as an anti-galling agent which is coated or plated over the appropriate finished bond necessary for attaching the super abrasive particles to the particular substrate. The present method for plating the super abrasive particles to a particular substrate therefore modifies the above-explained known process as follows. Instead of completing the plating and bonding process to the desired bonding height, the plating process described above is stopped at least a coating thickness, typically about 0.0002 to 0.0005 inch, short of the desired bond thickness and, at this point, a third plating process is activated and a relatively thin deposit of nickel/phosphorous/Teflon or other equivalent type material as will be hereinafter explained is Plated or applied over the top of the bond already established between the abrasive particles 21 and the substrate 22 illustrated in FIG. 3. The results of this third plating process are illustrated in FIG. 4 and, more particularly, in the enlarged, partial side-elevational view illustrated in FIG. 5. As best shown in FIG. 5, this additional layer or coating 28 of a nickel/phosphorous alloy material includes micron-sized Teflon particles occluded therein to provide anti-stick and anti-gall properties to the bond. The anti-galling composite coating 28 applied over the known bond (24 and 26) is typically about 0.0002 to about 0.0005 inch thick so that the overall bond thickness will remain approximately the same as compared to known bonding techniques.

It is important to note that a wide variety of other metals and metal alloys as well as other surface friction reducing or lubricating type materials may be utilized as the composite anti-galling coating material depending upon the construction of the particular honing tool and the characteristics of the honing application. For example, any of the well known metals and alloys capable of being joined to a metal substrate can be used in the practice of the present invention. Alloys such as nickel-phosphorus compositions, nickel-boron compositions, nickel-chromium compositions, nickel-tungsten compositions, and other nickel based alloys are particularly useful. Various metallic carbides such as tungsten carbide, chromium carbide and other metallic carbides can likewise be used. For certain applications, pure metals such as chromium, nickel, copper, cobalt, or aluminum may also be used.

With respect to the lubricating or friction reducing agent in the anti-galling composite material, this agent may be any composition which can be occluded in metal or metal alloys and which can form at least a semi-continuous lubricating type surface to which the abraded stock material from a honing operation will not agglomerate. Such compositions may be polymers such as the preferred polymer Teflon (polytetrafluoroethylene) marketed by E. I. duPont de Nemours & Company, or such compositions may be silcone polymers, acrylonitrile polymers and copolymers, polyamides, polycarbonates, polymers and copolymers of polyoelfins such as ethylene, propylene and butylene, butadiene-styrene copolymers and other known polymeric materials. Also, natural lubricants such as graphite, mica and so forth may be used. Molybdenum disulphide will also work in the practice of the present invention. Thus, particles from any material which can be co-deposited with metal particles from a plating solution and which will lower the friction coefficient of the coating surface so as to form a smooth, slick surface, which smooth, slick surface is sometimes referred to herein as a lubricating surface, may be used in the practice of the present invention.

Although it is preferred that the third plating process be an electroless plating process, any suitable means including an electroplating process may be utilized to plate the anti-galling agent over the bond already established between the abrasive particles and the substrate. It is also recognized that any number of coatings of the friction reducing, anti-galling agent can be applied over the known bond to achieve any desired bond height.

Testing has verified and demonstrated that the present improved process for plating super abrasive materials onto a honing tool prevents the metal chips and shavings produced during a honing operation from building up and collecting between the abrasive particles. This is true because of the friction reducing or lubricating characteristics associated with the Teflon particles occluded within the nickel/phosphorous alloy or other suitable equivalent type anti-stick, anti-gall coating material. The respective size of the metallic and lubricating particles in the present coating as well as the respective proportions thereof result in a surface having at least a semi-continuous plane of lubricating material which functions as a lubricating surface to which the metal chips and shavings produced during a honing operation do not adhere. Generally the size of the metal particles will range from about 0.5 microns to about 80 microns in diameter and the size of the lubricating or friction reducing particles will range from about 0.1 microns to about 10 microns in diameter, the preferred particle size being about 1–2 microns in diameter. Best results can be achieved when the lubricating or friction reducing particles range from about 10% to about 25% of the entire anti-galling coating composition, which composition includes the deposited metal or metal alloy particles and the deposited lubricating or friction reducing particles. The use and application of this very specific composite material coating as explained above substantially eliminates the above-identified problems of galling and scoring of the particular workpiece and of the abrasive bond during honing.

Figure 6:
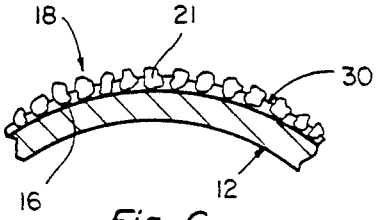
FIG. 6 is an enlarged, partial cross-sectional view taken along line 6—6 of FIG. 1 illustrating the bonding of an abrasive material onto the working portion of a honing tool in accordance with the teachings of the present invention.

FIG. 6 is an enlarged, partial cross-sectional view taken through the working portion 18 of the honing member 12 of FIG. 1 illustrating the resultant bond 30 between the super abrasive particles 21 and the honing member 12 produced in accordance with the teachings of the present process. The micron-sized Teflon particles occluded within the coating 28 (FIG. 5) provide a substantially smooth, anti-stick, anti-gall surface which prevents the metal chips and shavings produced during a honing operation from building up, collecting and welding or otherwise bonding themselves onto such surface between the abrasive particles. Also, although the present process has been described as a three-step bonding and coating process wherein the third coating process involves applying a nickel/phosphorous/Teflon composite coating or other equivalent composite coating over the top of the double bond established between the abrasive particles and the honing tool, it is recognized that any number of plating steps may be utilized to achieve the desired bond between the abrasive particles and the particular substrate, and any number of plating processes may be utilized to achieve the desired anti-stick, anti-galling coating thickness. It is also recognized that the above-described process may likewise be utilized for plating any abrasive material, not necessarily a super abrasive material, onto a honing tool or other substrate.

Figure 7:
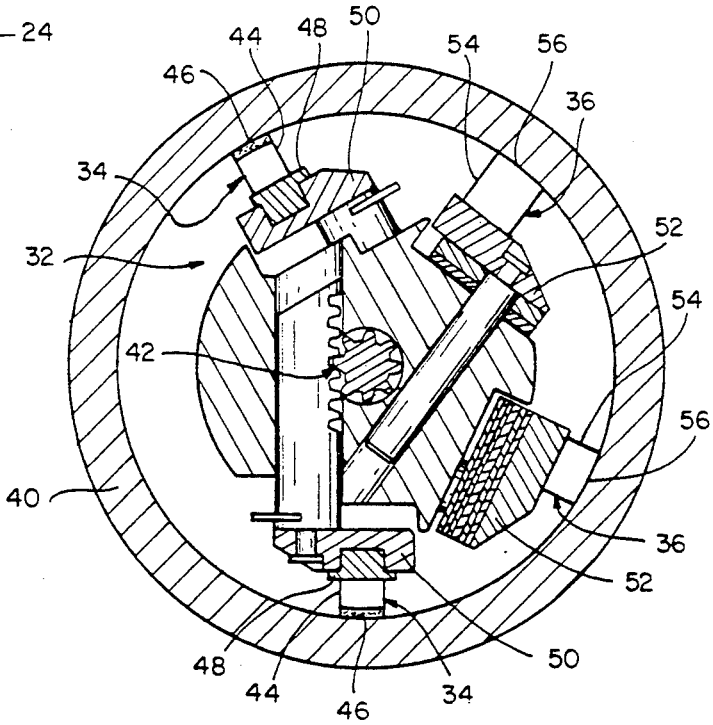
FIG. 7 is a cross-sectional view of one embodiment of another honing mandrel wherein the present invention also has particular utility, the honing mandrel being shown in operative position in a cylinder to be honed.

FIG. 7 illustrates one embodiment 32 of many possible embodiments of a typical radially expandable type honing mandrel construction for which the present invention likewise has particular utility. The honing mandrel 32 utilizes a plurality of circumferentially spaced work engaging members such as the stone assemblies 34 and the shoe or guide assemblies 36, one or more of such work engaging members 34 and 36 being radially adjustable during a particular honing operation to maintain the stone and/or guide assemblies in contact under pressure with a work surface being honed such as the cylindrical work piece 40. In such constructions, the stone assemblies perform the honing or grinding operations while the shoe or guide assemblies stabilize the mandrel and provide support for the stone assemblies. Many known stone and guide assemblies and stone and guide assembly movement means have been devised and used to accomplish this task. In the mandrel construction 32 illustrated in FIG. 7, a rack and pinion gear arrangement 42 accounts for the radial movement of the work engaging members 34 and 36. The stone assemblies 34 each include a work engaging member 44 having an abrasive portion 46 associated therewith, the work engaging member 44 being mounted on a backing member 48 which in turn is attached to or mounted on a support structure 50. In such a honing mandrel construction, the present anti-galling composite coating 28 could be applied over the bond already established between the abrasive portion 46 and the member 44 to achieve the aforementioned objectives.

Referring again to FIG. 7, the guide assemblies 36 each include a backing or support portion 52 having a relatively non-abrasive upstanding work engaging member 54 projecting upwardly from the backing member 52 as shown. Since the guide assemblies 36 function to stabilize and provide backing for the hones on the mandrel 32 during a honing operation, the work engaging guide members 54 are preferably constructed of a relatively inexpensive malleable or ductile material such as materials that include zinc or zinc alloys which is characterized by being relatively non-abrasive and more likely to slide on a work surface than to abrade it. Zinc is also a relatively easy material to cast and is generally preferred although other relatively non-abrasive materials such as bronze, brass and certain plastic materials could be used for this application. Since shoe or guide assemblies make contact with the work surface to be honed, and since such assemblies are specifically designed to be as non-abrasive as possible, it is also anticipated and recognized that the present anti-galling composite coating 28 could likewise be applied over the top of the work engaging surface of the guide members 54 such as the work engaging guide surfaces 56 (FIG. 7) to even further reduce the friction coefficient of such surfaces. This provides a smooth, anti-stick, anti-galling coating over the top of the work engaging guide assembly and further ensures against the problems of galling and scoring of the honed work surface. Still other uses and applications of the present invention to provide anti-stick and anti-gall properties to a work engaging surface during a honing operation are recognized and anticipated.

The present method represents an important advancement in the honing art in that it substantially reduces and alleviates the above-identified problems of galling and scoring of the honed work surface thereby increasing the quality of the finished work product and it also increases the overall service life of the tool.

Thus, there has been shown and described a novel method for plating super abrasive materials onto a honing tool as well as an improved honing tool construction produced thereby, which method and tool fulfill all of the objects and advantages sought therefor. Many changes, modifications, variations, and other uses and applications of the present method and tool will, however, become apparent to those skilled in the art after considering this specification and the accompanying drawings. All such changes, modifications, variations, and other uses and applications which do not depart from the spirit and scope of the invention are deemed to be covered by the invention which is limited only by the claims which follow.

What is claimed is:

1. A method for plating abrasive particles onto the surface of a work engaging honing member, said method comprising:

(a) attaching said abrasive particles to the surface of said work engaging member by means establishing an abrasive bond therebetween;

(b) applying a coating of a relatively thin layer of a composite material over the top of the bond established between said abrasive particles and said work engaging member, said composite material comprising a metallic material capable of bonding with said abrasive bond and a non-abrading friction reducing material, said non-abrading friction reducing material being of sufficient quantity in said composite material to produce a relatively smooth, slick surface over the top of said abrasive bond by and between said abrasive particles.

2. The method of claim 1 wherein said means for attaching said abrasive particles to the surface of said work engaging member includes a metal plating process.

3. The method of claim 2 wherein said metal plating process is an electroplating process.

4. The method of claim 1 wherein said relatively thin layer of a composite material is applied over the top of the bond established between said abrasive particles and said work engaging member by means of an electroless plating process.

5. The method of claim 1 wherein said composite material is a nickel/polytetrafluoroethylene (Teflon) composite material.

6. The method of claim 5 wherein said nickel/polytetrafluoroethylene composite material includes a nickel/phosphorous alloy material having micron-sized polytetrafluoroethylene particles occluded therein.

7. The method of claim 1 wherein said coating of said composite material is in the range from about 0.0002 to about 0.0005 inch thick.

8. The method of claim 1 wherein said abrasive particles include diamond particles.

9. The method of claim 1 wherein said abrasive particles include particles of cubic boron nitride.

10. The method of claim 1 wherein said work engaging member is the working portion of a honing tool.

11. The method of claim 1 wherein said work engaging member is the abrading portion of a honing tool.

12. The method of claim 1 wherein said work engaging member is a honing stone assembly.

13. The method of claim 1 wherein said friction reducing material is selected from the group consisting of polytetrafluoroethylene, molybdenum disulfide, mica, graphite and fluorocarbon resins.

14. A method for plating abrasive particles onto the surface of a work abrading member, said method comprising:

(a) bonding said abrasive particles to the surface of said work abrading member by using a metal plating process to establish a bond between said abrasive particles and said work abrading member; and (b) plating a relatively thin layer of a metal/polytetrafluoroethylene composite material over the top of the bond established between said abrasive particles and said work abrading member as a result of step (a) above.

15. The method of claim 14 wherein said metal/polytetrafluoroethylene composite material is a nickel/polytetrafluoroethylene composite material.

16. The method of claim 15 wherein said nickel/-polytetrafluoroethylene composite material includes a nickel/phosphorous alloy material having micron-sized polytetrafluoroethylene particles occluded therein.

17. A method for plating abrasive particles onto the work engaging surfaces of a honing tool, said method comprising:

(a) bonding said abrasive particles to the work engaging surfaces of said honing tool by using an electroplating process to establish a bond between said abrasive particles and said work engaging surfaces; and (b) bonding a relatively thin layer of a composite material over the top of the bond established between said particle particles and said work engaging surfaces by using an electroless plating process, said composite material including a metallic material capable of bonding with said abrasive bond and having a non-abrading friction reducing agent associated therewith, said non-abrading friction reducing agent being of sufficient quantity in said composite material to produce a substantially smooth, relatively slick surface over the top of said abrasive bond.

18. The method of claim 17 wherein said non-abrading friction reducing agent is polytetrafluoroethylene.

19. The method of claim 17 wherein said composite material is a nickel-phosphorous alloy material having micron-sized polytetrafluoroethylene particles occluded therein.

20. The method of claim 17 wherein said relatively thin layer of said composite material is in the range from about 0.0002 to about 0.0005 inch thick.

21. A method for plating an abrasive material onto the working portion of a honing tool, said method comprising the following steps:

(a) placing the working portion of said honing tool and said abrasive particles into a first electroplating bath so as to establish an initial thin bond of electroplated material by and between a first adjacent layer of abrasive particles and the working portion of said honing tool;

(b) removing any surplus layers of abrasive particles which may be associated with the adjacent first layer of particles initially bonded to the working portion of said honing tool as a result of step (a) above;

(c) placing the working portion of said honing tool with said first adjacent layer of abrasive particles initially bonded thereto into a second electroplating bath so as to build-up the bond between said first adjacent layer of particles and the working portion of said honing tool; and (d) placing the working portion of said honing tool and the abrasive particles bonded thereto into a third plating bath wherein a relatively thin layer of a metallic material having a friction reducing agent occluded therein is placed over the top of the bond already established between said abrasive particles and the working portion of said honing tool, said metallic material being bondable with the bond already established between said abrasive particles and the working portion of said honing tool, said friction reducing agent being present in sufficient quantity in said metallic material so as to produce a relatively smooth, slick surface over the top of said abrasive bond by and between said abrasive particles.

22. The method of claim 21 wherein said metallic material having a friction reducing agent occluded therein is a nickel-phosphorous/polytetrafluoroethylene material.

23. The method of claim 21 wherein said third plating both is an electroless plating bath.

24. A honing tool adapted to be mounted for rotation on a honing machine comprising an elongated tubular member having an outer surface with abrasive particles and a binder for attaching the abrasive particle thereto extending over a portion of the length thereof, said abrasive particles defining the work engaging portion of said tool, a relatively thin layer of a composite material extending over and attachable to at least a portion of the surface of said working engaging tool portion by and between the abrasive particles attached thereto, said composite material including a metallic material capable of bonding to said binder and a non-abrading friction reducing material, said non-abrading friction reducing material being of sufficient quantity in said composite material so as to produce a relatively smooth slick surface by and between said abrasive particles.

25. The honing tool defined in claim 24 wherein said composite material is a metal/polytetrafluoroethylene material.

26. The honing tool defined in claim 24 wherein said composite material is a nickel/phosphorous alloy having micron-sized polytetrafluoroethylene particles occluded therein.

27. The honing tool defined in claim 24 wherein said abrasive particles include particles of a super abrasive material.

28. The honing tool defined in claim 24 wherein said abrasive particles include diamond particles.

29. The honing tool defined in claim 24 wherein said abrasive particles include particles of cubic boron nitride.

30. In a honing mandrel having at least one work abrading member associated therewith, said work abrading member having abrasive particles and a binder for attaching the abrasive particles thereto extending over at least a portion thereof, said improvement comprising coating the abrasive portion of said work abrading member with a relatively thin layer of an anti-galling agent, said anti-galling agent including a metallic material capable of bonding with said binder and a non-abrading friction reducing material, said non-abrading friction reducing material being of sufficient quantity in said anti-galling agent so as to produce a relatively smooth slick surface by and between said abrasive particles.

31. The improvement defined in claim 30 wherein said anti-galling agent is a metal/polytetrafluoroethylene material.

32. The improvement defined in claim 31 wherein said metal/polytetrafluoroethylene material is a nickel/phosphorous alloy having micron-sized polytetrafluoroethylene particles embedded therewithin.

33. In a honing mandrel having work engaging members associated therewith and wherein at least one of said work engaging members is a honing guide assembly, said improvement comprising coating the work engaging surface of said honing guide assembly with a relatively thin layer of a composite material, said composite material including a metallic material having a friction reducing agent associated therewith, said friction reducing agent being of sufficient quantity in said composite material so as to produce a relatively smooth surface over the top of the work engaging surface of said honing guide assembly, said metallic material being selected from the group consisting of nickel, nickel-phosphorous, nickel-chromium, nickel-boron, copper, cobalt, brass, chromium, aluminum and bronze, and said friction reducing agent being selected from the group consisting of polytetrafluoroethylene, molybdenum disulfide, mica, graphite and fluorocarbon resins.

34. The method of claim 1 wherein said metallic material is selected from the group consisting of nickel, nickel-phosphorous, nickel-boron, nickel-chromium, copper, cobalt, brass, chromium, aluminum and bronze.

35. The method of claim 14 wherein the metallic material in said metal/polytetrafluoroethylene composite material is selected from the group consisting of nickel-boron, nickel-chromium, copper, cobalt, brass, chromium, aluminum and bronze.

36. The honing tool defined in claim 24 wherein said metallic material is selected from the group consisting of nickel, nickel-phosphorous, nickel-boron, nickel-chromium, copper, cobalt, brass, chromium, aluminum and bronze.

37. The honing tool defined in claim 24 wherein said non-abrading friction reducing material is selected from the group consisting of polytetrafluoroethylene, molybdenum disulfide, mica, graphite and fluorocarbon resins.

* * * * *

UNITED STATES PATENT AND TRADEMARK OFFICE

CERTIFICATE OF CORRECTION

PATENT NO. : 5,178,643

DATED : January 12, 1993

INVENTOR(S) : John J. Schimweg

It is certified that error appears in the above-indentified patent and that said Letters Patent is hereby corrected as shown below:

Column 6, line 68, "Plated" should be --plated--.

Column 11, line 15, "particle" should be --abrasive--.

Column 11, line 58, "placed" should be --plated--.

Column 12, line 6, "both" should be --bath--.

Signed and Sealed this

Twenty-sixth Day of October, 1993

*Attest:*

*Attesting Officer*

BRUCE LEHMAN

*Commissioner of Patents and Trademarks*